US007000887B1

(12) United States Patent
Mulhern

(10) Patent No.: US 7,000,887 B1
(45) Date of Patent: Feb. 21, 2006

(54) SNOW MOLD

(76) Inventor: Patrick M. Mulhern, 371 High Meadow Ct., Wyckoff, NJ (US) 07481

( * ) Notice: Subject to any disclaimer, the term of this patent is extended or adjusted under 35 U.S.C. 154(b) by 76 days.

(21) Appl. No.: 10/648,668

(22) Filed: Aug. 26, 2003

(51) Int. Cl.
*B29C 67/24* (2006.01)

(52) U.S. Cl. ..... 249/157; 249/155

(58) Field of Classification Search ..... 249/48, 249/51, 134, 155, 157
See application file for complete search history.

(56) References Cited

U.S. PATENT DOCUMENTS 993,914 A * 5/1911 Truman ..... 249/157
5,658,597 A * 8/1997 Breidenstein et al. ..... 425/2
6,176,464 B1 * 1/2001 Harvey ..... 249/126

* cited by examiner

*Primary Examiner*—Donald Heckenberg
(74) *Attorney, Agent, or Firm*—W. Patrick Quast, Esq.

(57) ABSTRACT

A snow mold is disclosed for making a snowman and similar snow structures. A flexible sheet of material has tabs formed at one end, and slots cut into the sheet at spaced intervals along the length of the sheet in horizontal alignment with the tabs. The slots are also in vertical alignment with one another at these spaced intervals, each slot containing area defining a particular circle diameter. Pushing the tabs into the slots provides different circular forms which can be filled with snow. First one circle of snow is formed, the mold can be reconfigured to a smaller diameter and placed on the formed circle of snow, filled with snow, and so on. A replica of a snowman is rapidly created. The inexpensive snow mold is then simply rolled up and stored for future use.

3 Claims, 5 Drawing Sheets

SNOW MOLD

This invention relates to molds for forming various objects, and in particular to molds for forming snow into the appearance of a typical snowman.

BACKGROUND

Forming shapes out of snow to resemble a man is, of course, an ancient art. Problems related to this often child centered activity include the consistency of the snow, the quantity of available snow, and fatigue resulting from lifting heavy snow. Numerous prior attempts have been made to solve these and related problems. For example, U.S. Pat. No. 6,083,072, issued Jul. 4, 2000, teaches the use of a "snow swirl" to vertically lift now or sand into a free standing compressed column as illustrated by FIGS. 3A, B, C, and D. U.S. Pat. No. 6,176,464B1, issued Jan. 23, 2001, teaches the use of three globular shaped molds 100, 100', and 100" (FIG. 1), held together with fasteners 140, for filling with snow. Latches 108, 108', and 108" are then released to remove the globular molds and reveal the formed snowman replica. In U.S. Pat. No. 5,863,451, issued Jan. 26, 1999, a series of panels 10 are interconnected and filled with snow 30 to form the shape of a dome (FIG. 6). The panels are then removed and the snow dome can then be hollowed out to form a snow shelter (FIGS. 12 and 13). Additional descriptions of snow molds for fabricating traditional snowmen include U.S. Pat. No. 5,851,415, issued Dec. 22, 1998, which teaches a figurine 10 which can be the shape of a snowman, the figurine being a split open configuration (FIG. 5) for convenient snow removal after filling with snow (FIG. 6). Similarly U.S. Pat. No. 5,632,926, issued May 27, 1997, teaches a snowman mold with catch secured base 11, torso 12, and head member 13 forming an integral mold cavity 10A (FIG. 2). Further, U.S. Pat. No. 4,164,341, issued Aug. 14, 1979, teaches a three section (17, 18, 19—FIG. 1) bipartite mold for fabricating a snowman, with snow packing facilitating openings 37, 38 (FIG. 2) in sections 18, 19. And U.S. Pat. No. 3,059,279, issued Oct. 22, 1962, teaches a multi-bipartite sectional interlocked snow mold (FIG. 2) secured by snap fasteners 50–52 (FIGS. 3–4). Additionally, a mold for an adjustable cake-pan is disclosed in U.S. Pat. No. 993,914, issued May 30, 1911, which teaches varying the diameter of a body portion of a bake pan for varying cake sizes.

While the above noted disclosures provide useful methods and devices related to molding snow into enjoyable shapes, they do not envisage the simplicity and economy of the present invention.

It is therefore a primary object of the present invention to provide a snow mold for quickly and easily fabricating a snowman.

An additional object of the invention is to provide a snow mold of simple construction for use by children.

Still another object of the invention is to provide an inexpensive snow mold.

Yet another object is to provide a snow mold that is quickly and conveniently stored when not in use.

A further object of the invention is to provide a multi-purpose form for shaping a variety of simple forms in moldable materials.

SUMMARY

These and other objects are obtained with the disclosure of the snow mold and method of the present invention.

Watching children or even adults make a snowman one is struck by the difficulties this seemingly simple pleasure encounters. Snow sometimes doesn't stick properly. Often enough snow isn't immediately available. And even grown-ups tire stacking a tall column of snow. Some of the solutions noted above involve relatively expensive molds that may not be easily understood by children. Additionally, these molds may prove cumbersome to store when not in use.

It occurred that a simple, inexpensive form could be used to make a snowman. Basically a snowman is three circular shapes of varying diameter, a base, a torso, and a head. Once they are in place the person fabricating the sculpture can use his or her imagination as to how to finish it off with charcoal eyes, nose, mouth, perhaps a pipe, and so on.

To this end I have devised a generally rectangular sheet of material measuring 96" long×24" wide. One or more tabs are constructed at one end of the sheet, and a series of slots are positioned along the length of the sheet. Depending on the number and position of the slots the sheet can now be formed into a circle of varying diameters. To use the snow mold of the invention, the tab end is grasped and the free end of the sheet is positioned adjacent the tab end. A slot is selected and the tab(s) is then pushed into the slot thereby locking the two ends together in the form of a circle. The slots are, of course, pre-positioned so as to line up with the tab ends, and are spaced along the length of the sheet in order to provide the desired different number of circles to be formed. Typically, three parallel slot arrangements are provided. The tabs are connected to the slots nearest the free end of the sheet, the snow mold of the invention is then put on end like a big doughnut and filled with snow. Snow can be simply shoveled onto the snow mold, being picked up either from the adjacent ground or form piles near the road. If the snow consistency is not of the correct consistency, it can be compacted or water sprinkled on it to make it stick.

Once the first layer is done, the mold is opened by simply pulling on the tabs. At this time the tabs and slots on the snow mold can be reconnected as before or the tabs can be repositioned into different slots to form a different diameter circle, and the snow mold is then positioned on top of the first formed circle of snow. After the second circle of snow is formed, the user can stop or continue to the next level. Once the desired height is achieved, the snow mold is simply rolled up and conveniently stored for future use. The user is now free to proceed to hand mold an assortment of snow items, such as snowmen, forts, walls, and other sculptures. Obviously the present invention isn't limited to snow, but can be used with other moldable materials, such as sand.

The snow mold is described above as being 24" wide×96" in length, but, of course, these dimensions can vary widely depending on projected use. Again, the number and placement of tabs and slots will be dictated by desired end structures. The tab/slot attachment method is inexpensive and functional, but is by no means essential to the present invention. A variety of attachment means can also be employed according to designer preference, including clasp and buckle arrangements, VELCRO, and other hook and loop fasteners.

The snow mold itself is preferably fabricated as a flexible sheet of material that can be easily rolled up and conveniently stored when not in use. Plastics such as vinyl and polyethylene would be suitable materials, as would be elastomeric materials including natural rubber or synthetic elastomers.

Thus it can be seen that the present invention of a snow mold offers unique, new conveniences and economy not heretofore available. With this simple, inexpensive structure children and adults can easily construct a respectable snowman replica in a matter of ten to 20 minutes. Once the snowman is done, the snow mold is simply rolled up and stored, instantly available for future use.

DETAILED DESCRIPTION OF THE DRAWINGS

Figure 1:
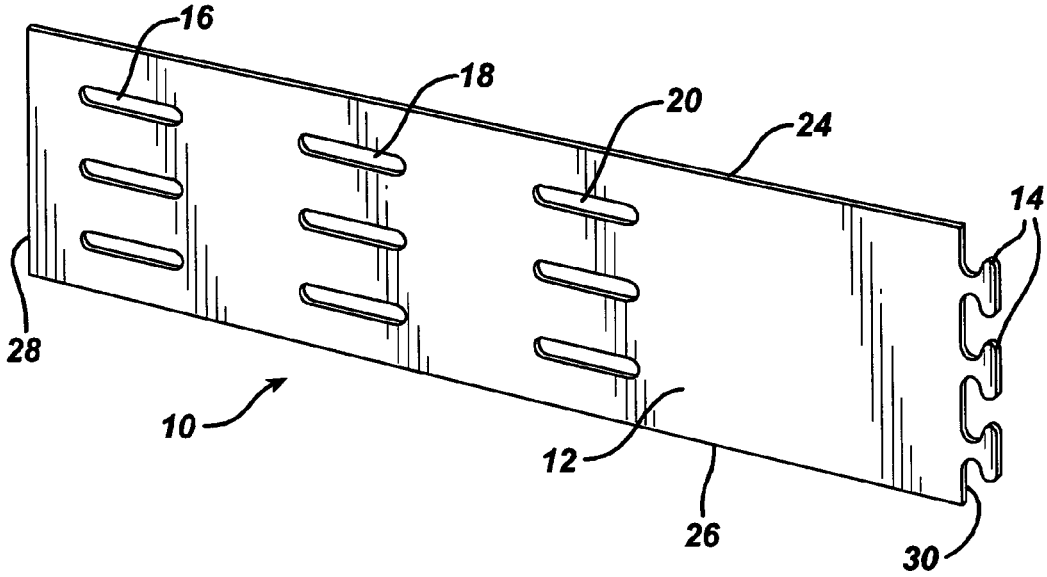
FIG. 1 is a top plan, perspective view of one version of the snow mold of the present invention.

Turning now to the drawings wherein similar structures having the same function are denoted with the same numerals, in FIG. 1 a version of the snow mold of the present invention is shown. The snow mold 10 is comprised of a flat sheet of flexible material 12, having slots (16,18,20) cut out along its length, and tabs 14 cut out or affixed at one end. The flat sheet 12 is preferably rectangular in shape, having a top edge 24, a bottom edge 26, a free end 28, and a tab end 30 to which the tabs 14 are affixed. The flat sheet 12 can have a width of 26", a length of 96", and a thickness of ¼", which numbers can vary depending on the intended uses for the snow mold. The flat sheet 12 is preferably easily rolled up and stored when not in use. Materials of fabrication can include plastics such as vinyl, polyethylene, and natural rubber as well as synthetic elastomers. The tab end 30 of the flat sheet 12 contains at least one tab 14, and preferably two or more. At least one slot (16, 18, 20), and preferably at least two slots, are positioned along the length of the sheet 12 in substantially parallel alignment with a midpoint of the extending tab 14. Each tab 14 has a narrow neck portion which can measure 1×⅝" in width, and an elongated head portion which can measure 4" in width. Each slot (16, 18, 20) can measure, for example, 4¾" in length×1¾" in width.

Figure 2:
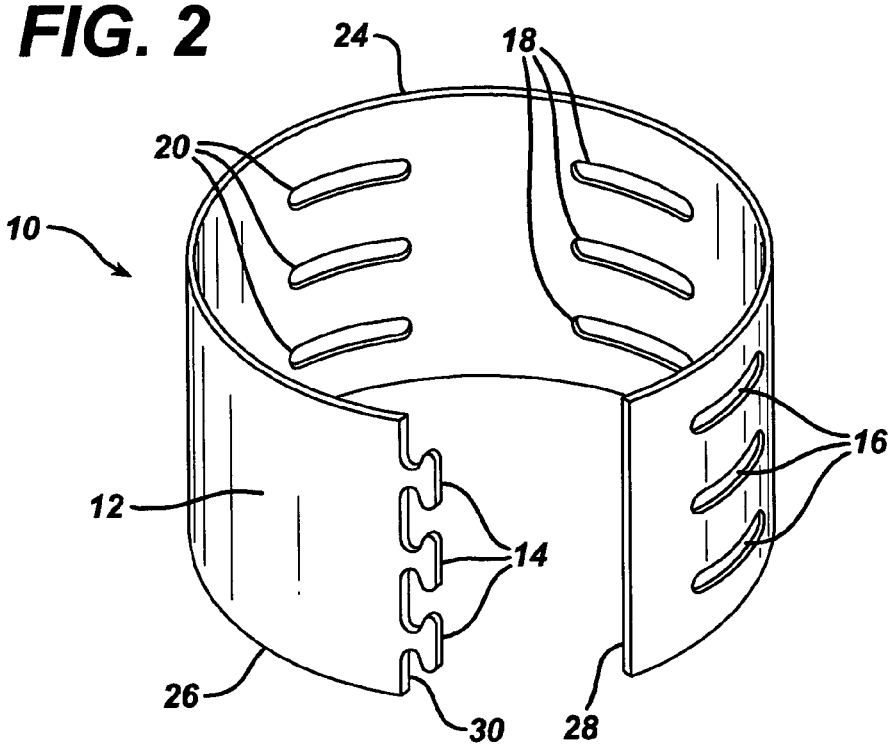
FIG. 2 is a side, elevational perspective view of one version of the snow mold of the present invention shown forming a circle prior to engagement of the ends of the snow mold.
Figure 3:
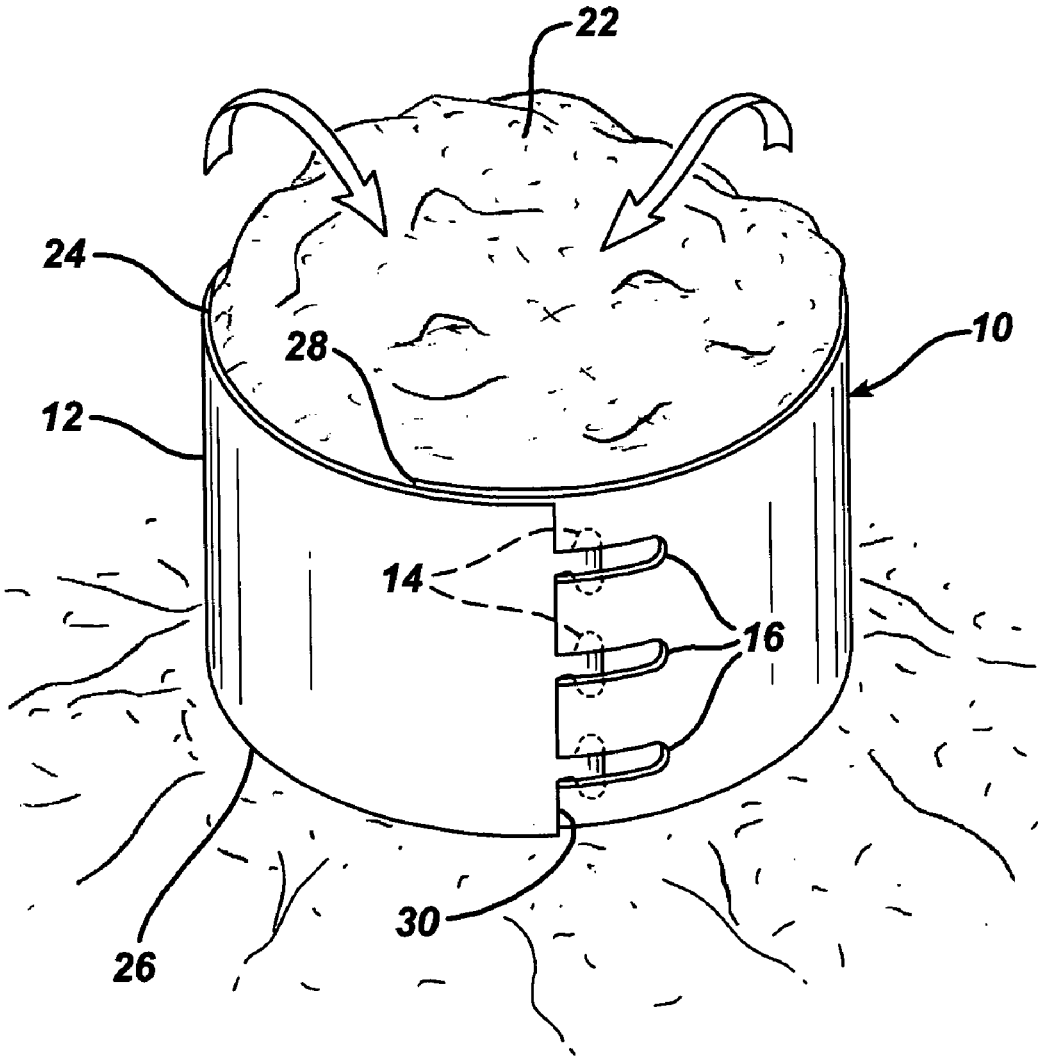
FIG. 3 is a view similar to that of FIG. 2, illustrating a formed circle filled with snow, with end tabs secured in a first set of slots to engage the ends of the snow mold.

As best seen in FIGS. 2 and 3 the purpose of the tabs 14 and slots (16, 18, 20) are to provide a simple, inexpensive method for engaging the tab end 30 and the free end 28 of the sheet 12 is a secure coupling in order to form a circle of a given diameter. In one version of the invention shown in FIG. 1 nine slots are shown, with each slot in each one of three sets of three being a spaced distance apart and substantially horizontally parallel to each other and a cooperating tab 14, and with each slot in each one of said three sets of three being a spaced distance apart and substantially in vertical alignment with one another and a top edge of the flat sheet.

To use the snow man of the invention the tab end 30 of the flat sheet 12 is grasped and free end 28 is positioned adjacent the tab end 30 so as to form a circle. As seen in FIG. 3 the tabs 14 area then pushed into selected horizontally parallel slots as, for example, the first set of horizontally parallel slots 16 so as to secure the formed circle in the selected diameter. Snow 22 may now be simply shoveled or otherwise placed into the now secured snow mold 10 until it is adequately filled with snow. To release the mold from the now packed snow circle, tabs 14 are simply pulled out of the slots 16.

Figure 4:
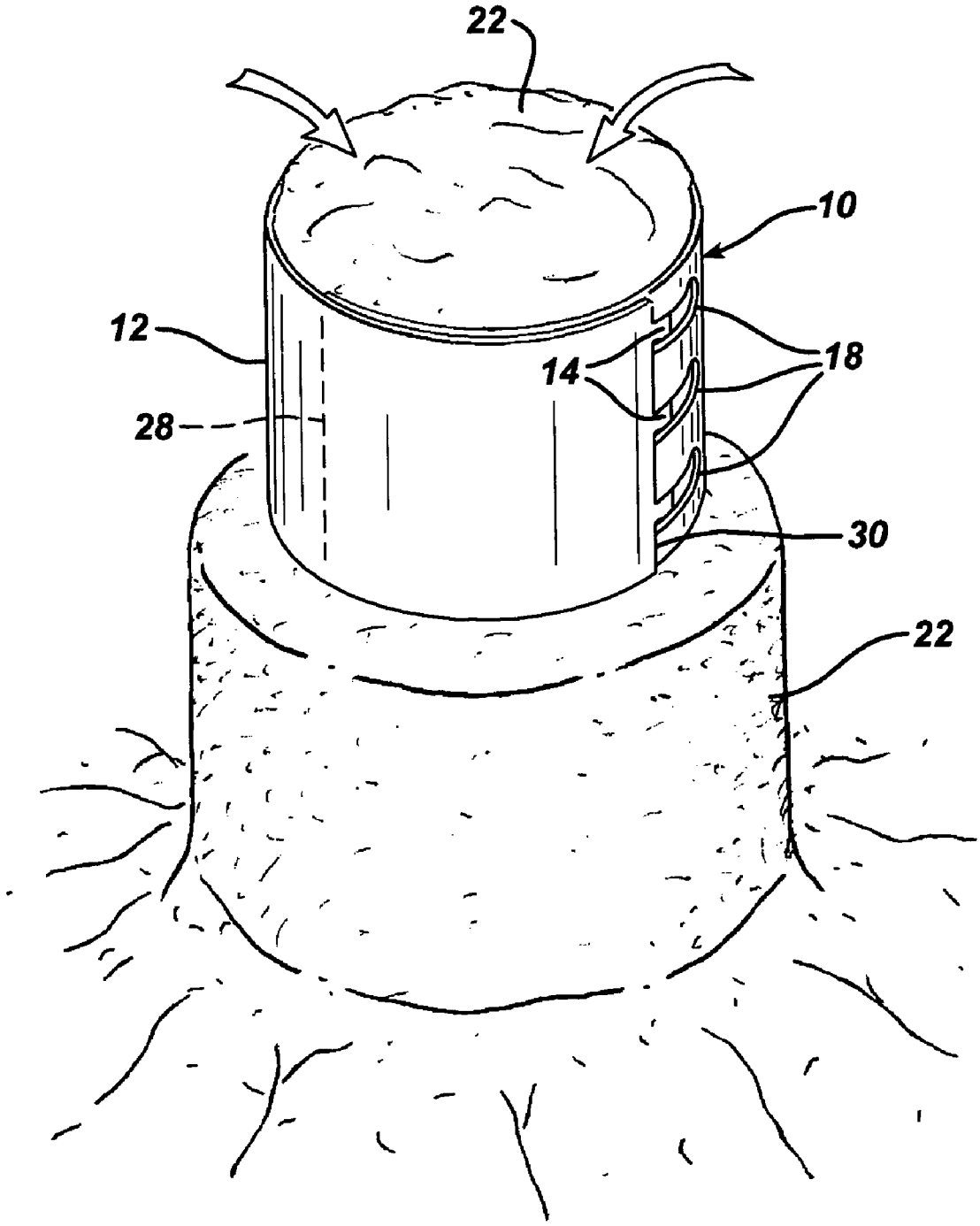
FIG. 4 is a perspective view of one version of the snow mold of the invention, with the snow mold now positioned on a previously formed circle of snow, with the tabs secured to slots creating a smaller diameter circle than that seen in FIG. 3.

As depicted in FIG. 4 the procedure can be repeated by simply placing the snow mold 10 onto an already formed circle of snow 22, and, if desired, the tabs may now be secured in a different set of slots, such as a second set of vertically aligned slots 18, to form a smaller diameter circle of snow.

Figure 5:
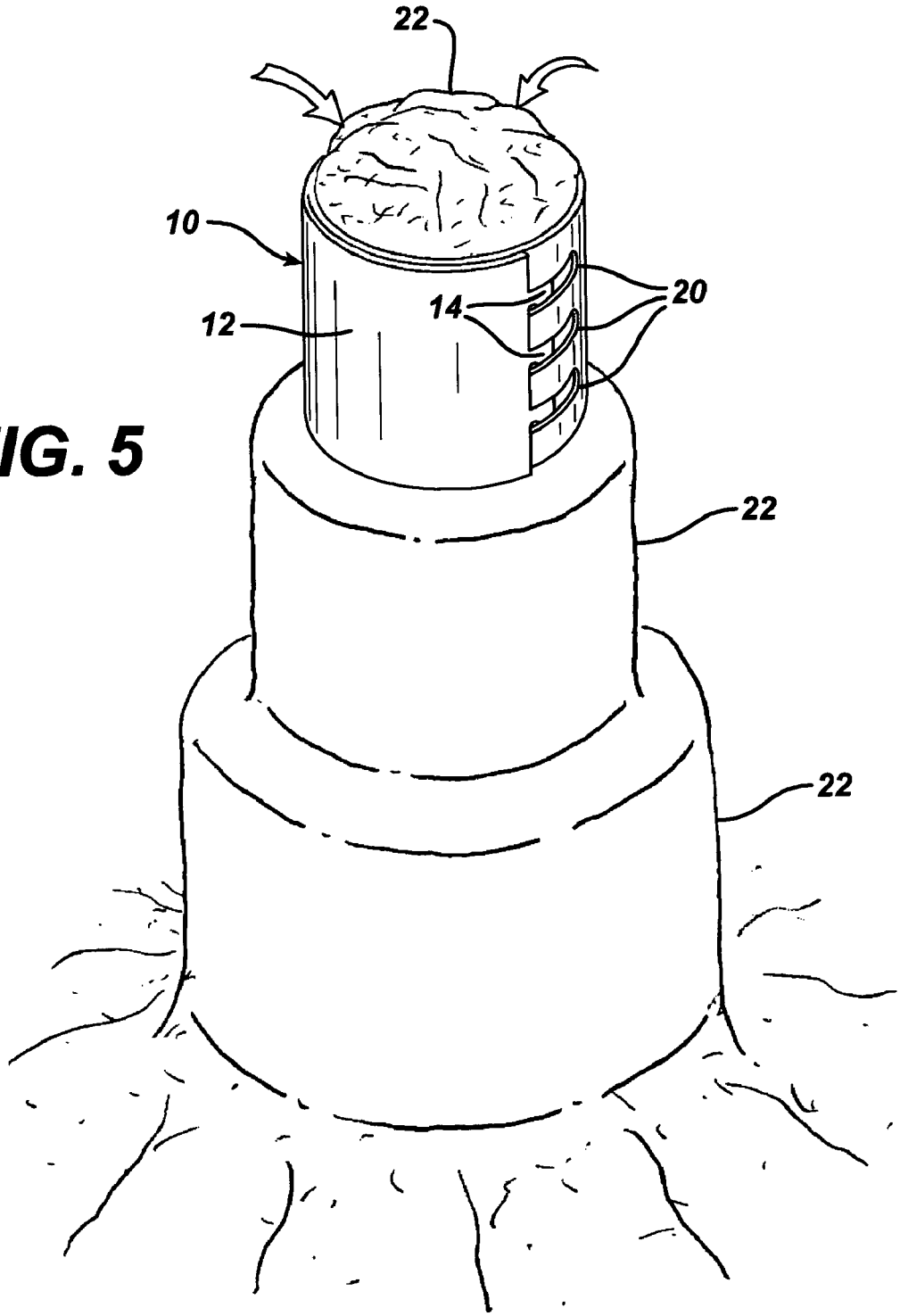
FIG. 5 is a perspective view similar to that of FIG. 4, with the snow mold now positioned on a second previously formed circle of snow, with the tabs secured to slots creating a smaller diameter circle than that seen in FIG. 4.

Again, in FIG. 5 the tabs 14 are shown secured in a third set of vertically aligned slots 20 to form a still smaller diameter circle of snow than that depicted in FIG. 4.

Figure 6:
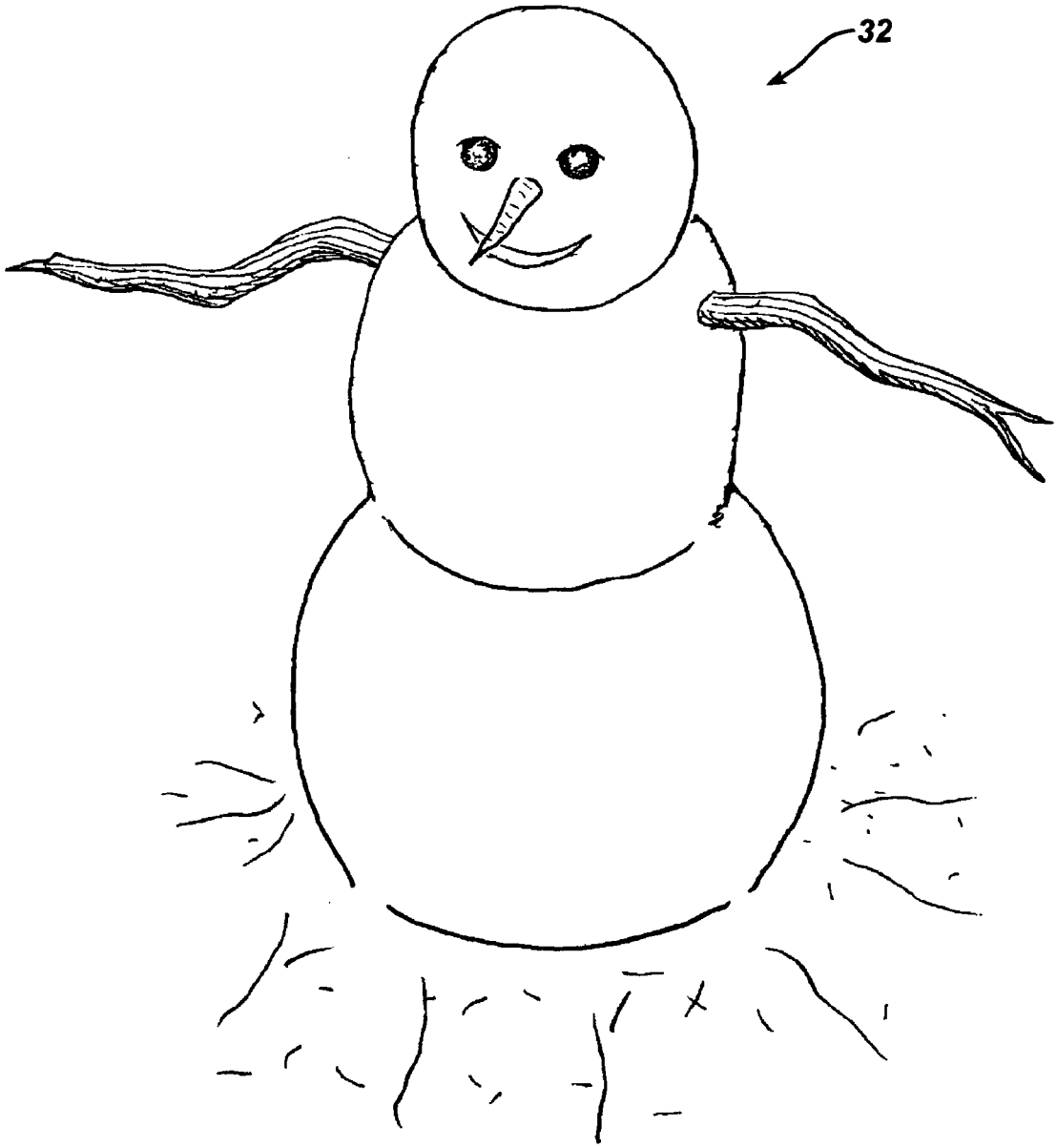
FIG. 6 is a perspective view of a typical snowman as fabricated and user embellished using one version of the snow mold of the present invention.

FIG. 6 illustrates a typical end result of the procedures shown in FIGS. 3, 4, and 5. The three different sized circles of snow formed one upon another, now clearly resemble a snowman 32. A user can now add charcoal features to the created head portion of the snowman, or a pipe and hat, and other embellishments to add to the enjoyment of the occasion. The entire procedure has been accomplished swiftly and economically, with the snow mold 10 now rolled up and put away for future use, ready whenever it snows again.

While the present invention has been disclosed in connection with versions shown in detail, various modifications and improvements will become readily apparent to those skilled in the art. Accordingly, the spirit and scope of the present invention is to be limited only by the following claims.

What is claimed is:

1. A mold for creating objects out of snow, comprising (a) a substantially rectangularly shaped flat sheet of flexible material, said flat sheet having a top edge, a bottom edge, a first end, and a second end;

(b) means for engaging said first end of said flat sheet to an area of said flat sheet a spaced distance away from said second end of said flat sheet, so that when said means for engaging said first end of said flat sheet is activated by an operator, said shape of said substantially rectangularly shaped flat sheet is formed into a circularly shaped sheet of a given diameter, said top edge of said first end and said second end being in the same plane, and said bottom edge of said first end and said second end being in the same plane, said now circularly shaped sheet of flexible material being placed on a ground surface and filled with snow, said means for engaging including a plurality of tabs affixed to said first end, and a plurality of slots positioned said spaced distance away from said second end, groupings of said slots being positioned at different respective areas denoting different circle diameters at spaced distances from said second end of said flat sheet, said plurality of slots being positioned substantially horizontally along the length of said flat sheet and substantially parallel to a midpoint of a cooperating tab, each grouping of said additional slots also being positioned in substantially vertical alignment a spaced distance from one another from said top edge of said flat sheet, said substantial horizontal positioning and substantial vertical alignment of said slots denoting circle diameters at said spaced distances from said second end of said flat sheet, so that when said operator connects said plurality of said tabs to said slots at both said horizontal position and said vertical alignment circle diameter denoting areas, an operator desired circularly shaped sheet of a given diameter is created.

2. The mold according to claim 1 wherein said flat sheet can be rolled up for storage when not in use.

3. The mold according to claim 2 wherein said flat sheet is fabricated from an elastomeric material.

* * * * *